United States Patent [19]

Lombardo

[11] 3,977,552

[45] Aug. 31, 1976

[54] PORTABLE COOLER FOR WINE AND OTHER LIQUIDS

[76] Inventor: Anthony Lombardo, c/o Architectural Panelling, Inc., 969 Third Ave., New York, N.Y. 10022

[22] Filed: Aug. 4, 1975

[21] Appl. No.: 601,485

[52] U.S. Cl. ..... 215/13 R

[51] Int. Cl.[2] ..... B65D 23/08

[58] Field of Search ..... 215/12 A, 13 R, 13 A, 215/100.5; 220/10, 85 K

[56] References Cited

UNITED STATES PATENTS

| | | | |
|---|---|---|---|
| 774,041 | 11/1904 | Coffin | 220/10 X |
| 2,115,654 | 4/1938 | Swofford | 215/13 R |
| 2,301,657 | 11/1942 | Lavaty | 220/10 |
| 2,788,149 | 4/1957 | Brown | 215/13 R |
| 2,881,936 | 4/1959 | Piker | 215/13 R |
| 2,974,814 | 3/1961 | Parsons | 215/13 R |
| 3,313,438 | 4/1967 | Piker | 215/13 R |

*Primary Examiner*—Donald F. Norton
*Attorney, Agent, or Firm*—Richard L. Miller

[57] ABSTRACT

A vessel of cylindrical upright shape and which is open on its upper end so that a bottle of wine or other liquid can be lowered thereinto; the vessel having a wall made with insulation so that any chilled bottle placed into the vessel will be unaffected by warm air on the outer side of the vessel, so that the bottle remains cold a long time.

3 Claims, 3 Drawing Figures

PORTABLE COOLER FOR WINE AND OTHER LIQUIDS

This invention relates generally to bottle coolers.

A principal object of the present invention is to provide a bottle cooler of improved construction in order to keep a chilled beverage cool while being served without the expense, inconvenience and mess of ice or water.

Another object is to provide a bottle cooler which accordingly will aid in preserving a glass bottle placed therein from breaking in case the cooler is bumped, dropped or knocked over.

Other objects are to provide a bottle cooler which is simple in design, inexpensive to manufacture, rugged in construction, easy to use, efficient in operation and which is portable.

Further objects of the invention will appear as the description proceeds.

To the accomplishment of the above and related objects, this invention may be embodied in the form illustrated in the accompanying drawing, attention being called to the fact, however, that the drawings are illustrative only, and that changes may be made in the specific construction illustrated and described within the scope of the appended claims.

Figure 1:
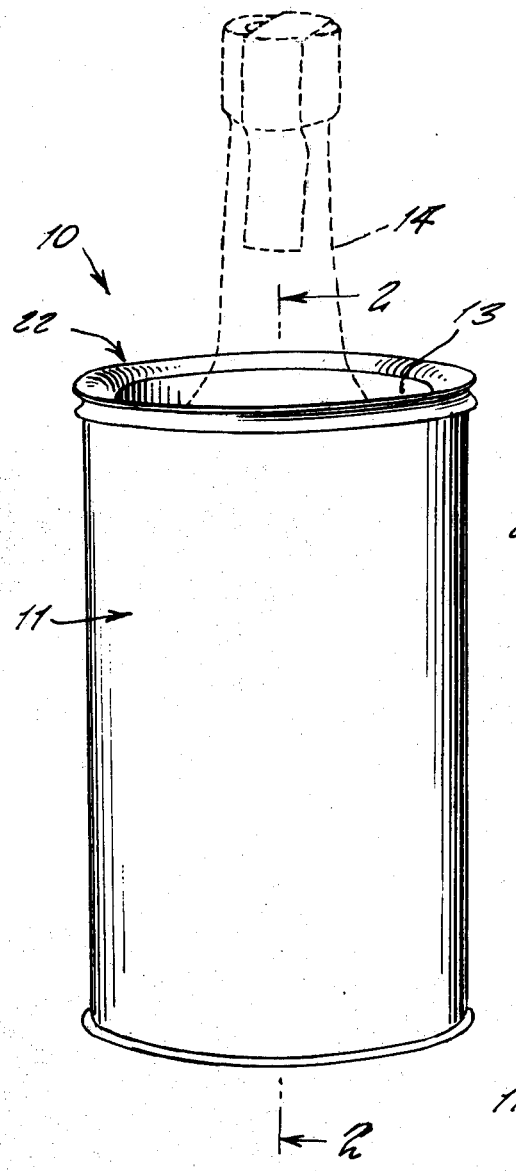
FIG. 1 is a perspective view of the invention.
Figure 3:
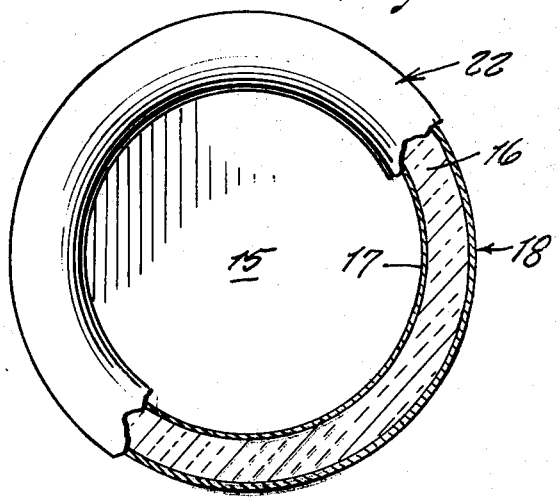
FIG. 3 is a view on line 3—3 of FIG. 2.

Referring now to the drawing in detail, the reference numeral 10 represents a portable cooler for wine and other liquids which includes a vertically upright cylindrical side wall 11 and a circular bottom wall 12; the upper end of the cooler having an opening 13 so that a bottle 14 of wine or other liquids can be lowered therethrough into a central chamber 15.

The side and bottom walls are made with a thick insulation 16 located between a thin plastic inner liner 17 and thin plastic outer plastic shell 18. The insulation may comprise fibre glass or urathane, or the like, and the inner liner 17 is preferably made in one piece. The outer shell is preferably made of two parts 19 and 20 so that they are connected together at the cooler lower peripheral edge by being rolled over together in order to form a sidewardly extending head 21 which is flush with the underside of bottom wall 12, and which serves as a sideward bumper.

Figure 2:
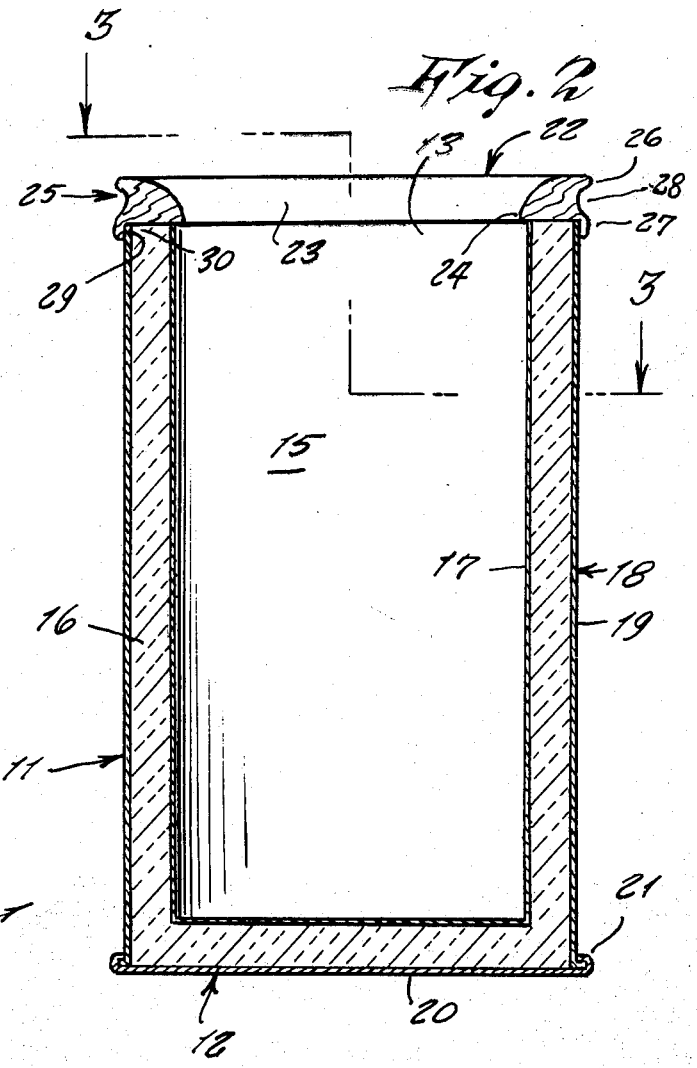
FIG.2 is a cross section on line 2—2 of FIG. 1.

Upon an upper edge of the side wall 11, there is secured a collar 22 made of wood, or the like and which has a downwardly tapering central opening 23 that is of convex curved shape when cross sectionally viewed as shown in FIG. 2. A lower end of the opening 23 projects inwardly at a smaller diameter than an inner diameter of the side wall 11 so to form an inwardly projecting lip 24 all around. An outer peripheral side 25 of the collar extends outwardly at a larger diameter than an outer diameter than the side wall 11 so to include an upper sidewardly projecting lip 26 and a lower sidewardly projection lip 27 with an annular concaved depression 28 therebetween. The lower lip 27 projects also downwardly around the outer side of side wall upper edge so that the collar construction includes an annular corner 29 formed by a large diameter counterbored opening 30 made in a lower side of the collar so that the upper end of the side wall 11 fits snuggly therein and is secured thereto fixedly by suitable means such as an adhesive or by other means.

It is now evident that sidewardly projecting bead 21 and collar 22 both serve as bumpers so to protect the cooler sidewall intermediate portion from being hit if the cooler is bumped with another object.

The downwardly constricting opening 23 guides a lowering bottle from striking the inner side of side wall 11.

Thus there is provided an improved bottle cooler. While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a portable cooler for wine and other liquids, the combination of an upright cylindrical side wall, and a circular bottom wall integral therewith so to form a central chamber accessible through a top opening for receiving a wine bottle or the like, said side wall and bottom wall being comprised of a thick insulation between a plastic inner liner and a plastic outer shell, said outer shell having a sidewardly bead at a lower end of said side wall, a wooden or the like collar being affixed upon an upper end of said side wall, said collar having a downwardly tapered central opening extending from its upper edge and a counterbored bottom opening fitting said side wall, and an outer peripheral side of said collar being of a larger diameter than said cooler side wall.

2. The combination as set forth in claim 1, wherein said downwardly tapered central opening of said collar comprises an inner side wall of said collar being cross-sectionally convex.

3. The combination as set forth in claim 2, wherein said outer peripheral side of collar includes an annular groove formed therein.

* * * * *